United States Patent [19]

Wolf

[11] Patent Number: 4,919,425

[45] Date of Patent: Apr. 24, 1990

[54] SHOOTING AND TRAINING AID FOR BASKETBALL PLAYERS

[76] Inventor: Jay W. Wolf, 2205 6th St., Marinette, Wis. 54143

[21] Appl. No.: 342,093

[22] Filed: Apr. 24, 1989

[51] Int. Cl.[5] ..... A63B 69/00

[52] U.S. Cl. ..... 273/1.5 A; 273/54 B

[58] Field of Search ..... 273/1.5 A, 54 B, 189 R, 273/189 A

[56] References Cited

U.S. PATENT DOCUMENTS

| | | | |
|---|---|---|---|
| 2,709,257 | 5/1955 | McKinney | 273/54 B X |
| 3,640,532 | 2/1972 | Bauer | 273/1.5 A |
| 3,707,730 | 1/1973 | Slider | 2/161 A |
| 3,820,783 | 6/1974 | Caveness | 273/1.5 A |
| 3,858,876 | 1/1975 | Williams | 273/1.5 A |
| 3,880,426 | 4/1975 | Morse | 273/54 B |
| 4,057,255 | 11/1977 | Bishop | 273/189 R |
| 4,062,540 | 12/1977 | Calentine | 273/54 B |
| 4,377,284 | 3/1983 | Okerlin | 273/1.5 A |
| 4,383,685 | 5/1983 | Bishop | 273/1.5 A |
| 4,579,341 | 4/1986 | Furr | 273/1.5 A |
| 4,677,971 | 7/1971 | Lindemann | 128/87 R |

*Primary Examiner*—Paul E. Shapiro

*Attorney, Agent, or Firm*—Hoffman, Wasson, Fallow & Gitler

[57] ABSTRACT

A training and shooting aid for basketball players to eliminate and prevent interference by the guide arm and guide hand when shooting a basketball. The training and shooting aid includes a pair of adjustable interconnected stretchable sleeves adapted to encircle a player's guide arm. One of the sleeves is intended to be snugly secured around the player's arm slightly above the elbow, while the other of the sleeves is intended to be snugly secured around the player's arm slightly below the elbow. A non-stretchable separable strap member has a free end adapted to be associated with one of the band members. The opposite end of the strap member is provided with a loop for placing around the thumb of the player's guide hand. Once the loop has been placed around the player's thumb, the strap member is adapted to be tightened, whereby the guide hand and thumb are pulled toward the elbow.

13 Claims, 1 Drawing Sheet

SHOOTING AND TRAINING AID FOR BASKETBALL PLAYERS

FIELD OF THE INVENTION

The invention pertains generally to a shooting and training aid for basketball players. More particularly, the invention relates to a shooting and training aid which is adapted to be worn by a basketball player for the purpose of developing a proper basketball shot and for increasing shooting percentages.

The invention addresses the problem of training novice basketball players in acquiring an efficient shooting technique. The relatively unskilled player tends to utilize both arms in propelling the ball to the basket. The latter tendency, wherein both the guide arm and the shooting arm are relied upon to project the ball, results in interference between the action of both arms. Because one arm usually dominates the other arm, it is difficult, if not impossible, to coordinate the shooting action between both arms, and the ball thus shot will follow an undesirable trajectory. If, however, the power for propelling the basketball toward the basket is provided only by the shooting arm and hand, with the guide arm and hand serving merely to guide the ball to the point of release, the proper ball trajectory is apt to ensue. Therefore, it is necessary to eliminate the common habit of novice players to utilize the guide arm and guide hand to assist in projecting the ball during the shot process if the correct shooting technique is to be attained.

Another common tendency frequently observed in the shooting action of young players is that of relying upon the thumb of the guide hand to assist in propelling the basketball. As was discussed above in connection with utilization of the guide arm, utilization of the thumb of the guide hand similarly interferes with the direction of the force that is generated by the dominant shooting hand and thereby negatively influences the trajectory followed by the basketball. Moreover, the thumb of the guide hand tends to impart an undesirable side spin motion to the ball, which also negatively affects the path of the basketball and gives rise to shooting inaccuracies.

Thus, the need exists for a basketball shooting and training aid which assists a player in acquiring the proper shooting technique by preventing the guide arm and hand from interfering with the action provided by the shooting arm and hand. The need further exists for a basketball shooting and training aid which prevents the thumb of the guide hand from being used to propel the basketball.

The present invention satisfies the foregoing needs by providing a shooting and training aid for basketball players which effectively eliminates the guide hand interference habit resulting from the use of the guide arm and guide hand during the shooting process. The invention accomplishes the preceding objectives by providing a device which possesses the additional attributes of being wearable on the guide arm of a player, being adaptable to a right or left handed player, being susceptible of ready and easy assembly upon the arm of a player, being adjustable for various arm sizes, being safe, and being capable of being worn for any type of shot, either a set shot or a jump shot.

The present invention is characterized by a further advantage, in that it does not prevent or discourage important beneficial uses of the guide arm and hand.

For instance, the invention still allows the guide hand to be used to catch the ball and to "feel" the ball. The latter feature is particularly important because good shooting technique requires that the guide hand be utilized during the initial stage of a shot to position and guide the ball. Thus, once the guide hand interference habit has been overcome, the player must be able to utilize the guide hand in the proper manner. The present invention overcomes the guide hand interference habit while simultaneously permitting the acquisition of desirable habits for the guide arm and hand.

DESCRIPTION OF THE PRIOR ART

Training and shooting aids for basketball are generally known in the prior art. Such devices, however, are typically directed to the shooting arm, and are often complex and cumbersome. For example, U.S. Pat. No. 4,383,685, which issued on May 17, 1983 to Bishop, discloses a training aid for basketball players including a vest to be worn by the player and a curved guide bar pivotally mounted on the vest. An elastic sleeve worn on the elbow of the player's shooting arm is provided with a carriage that moves along the guide bar to direct the player's shooting arm in a curved path for proper throw of the basketball.

U.S. Pat. No. 3,820,783, which issued to Caveness on June 28, 1974, teaches a basketball training aid which is intended to indicate the proper height to which the player's elbow should be raised in the shooting process. Caveness shows a belt-supported bracket having an upwardly and forwardly extending arm provided at its upper end with a transverse gage bar which indicates the preferred height to which the player's elbow should be elevated. A guide bar which depends from the gage bar indicates the preferred lateral position for the player's elbow. The components of the device are relatively adjustable.

Although it is known in the prior art to provide means for discouraging use of the guide arm and hand in teaching the proper methods for shooting baskets, such is done so only in an indirect manner. For instance, U.S. Pat. No. 4,377,284, which issued to Okerlin on Mar. 22, 1983, is directed to a basketball training device which inhibits utilization of both arms while shooting by restricting movement of the player's elbows. The device maintains the player's elbows in close proximity to each other as the ball is cast toward the basket. The device comprises a pair of stretchable sleeves adapted to be worn over the forearms of the guide and shooting arms adjacent the player's elbow. The sleeves are interconnected by means of a stretchable member which resists parting movement of the elbows.

Similarily, U.S. Pat. No. 4,579,341 to Furr, dated Apr. 1, 1986, restrains the elbow of a player's shooting arm by means of an L-shaped arm guide member connected to a support member which is secured to the back of a body harness worn around the torso of a player.

The prior art also generally teaches a variety of means for proper placement of a player's hands upon a basketball. U.S. Pat. No. 3,707,730 to Slider, for example, which issued on Jan. 2, 1973, discloses a basketball practice glove including thumb and finger portions, and palm, back and wrist portions. The palm portion spaces the player's palm from the basketball, while an adjustable strap between the thumb and index finger portions limits the extent to which the latter fingers can be separated. A stay provided on the back portion limits bending movement of the player's wrist. The glove is intended to cause the player's shooting hand to assume a cup-like shape so that the ball is controlled by the tips of the thumb and the fingers.

U.S. Pat. No. 3,640,532 to Bauer, which issued on Feb. 8, 1972, comprises an elongated flexible tube secured to the palm of a player's hand by means of elastic loop for the purpose of preventing the basketball from touching the palm. Auxiliary straps extending between the fingers of the player's hand keep them separated for proper handling of the ball.

Finally, U.S. Pat. No. 3,858,876, which issued to Williams on Jan. 7, 1975, teaches providing a basketball with visible and/or tactile markings, recessed lines, areas, etc. corresponding to the correct placement of the hands and fingers upon the basketball.

The prior art does not teach or suggest a training and shooting aid intended to be worn only upon the guide arm and hand for preventing interference by the guide arm due to inward rotation of the guide hand and thumb during the process of shooting a basketball.

SUMMARY OF THE INVENTION

The invention relates to a training and shooting aid for basketball players adapted to be worn upon the guide arm of a player and comprising first and second adjustable band members, one of which is adapted to encircle the player's guide arm slightly above the elbow, and the other of which is adapted to encircle the player's guide arm slightly below the elbow. Each of the band members has ends provided with securing means, such as Velcro® fasteners, for securing the ends together around the wearer's arm. The band members are intended to be capable of stretching and, as such, are fabricated of elastic or another stretchable material.

A pair of transverse strap members rigidly interconnect the band members at spaced locations along the length of the band members, being secured to the band members by means of permanent stitching or the like. A pair of "D" rings, preferably fabricated of metal, are anchored to one of the transverse strap members. The invention further comprises a separable third strap member, fabricated from a non-stretchable material and having a first free end and a second end terminating in a loop.

The training and shooting aid is intended to be utilized by a player placing the first band member upon his guide arm slightly above the elbow and the second band member slightly below the elbow. The ends of each of the band members are secured together by means of the Velcro® or other suitable securing means so that the band members snugly yet comfortably encircle the player's arm. The loop of the third strap member is placed over the thumb of the player's guide hand, and the strap is diagonally crossed over the top of the arm to the outer portion thereof, proximate the elbow, whereupon the free end of the strap is threaded through the "D" rings. The free end of the strap projecting through the rings is pulled upon so as to draw the guide hand and the thumb upward and outward toward the elbow.

The invention prevents the guide hand from rotating inwardly toward the basketball, thereby preventing the guide hand from applying a propulsive force to the ball. Moreover, the invention causes the thumb to be pulled toward the elbow, and therefore prohibits the thumb of the guide hand from contributing to projection of the basketball. The invention thus eliminates the common problem of guide hand interference, resulting in an unimpeded trajectory for the ball and higher shooting percentages.

DESCRIPTION OF THE PREFERRED EMBODIMENT

Figure 1:
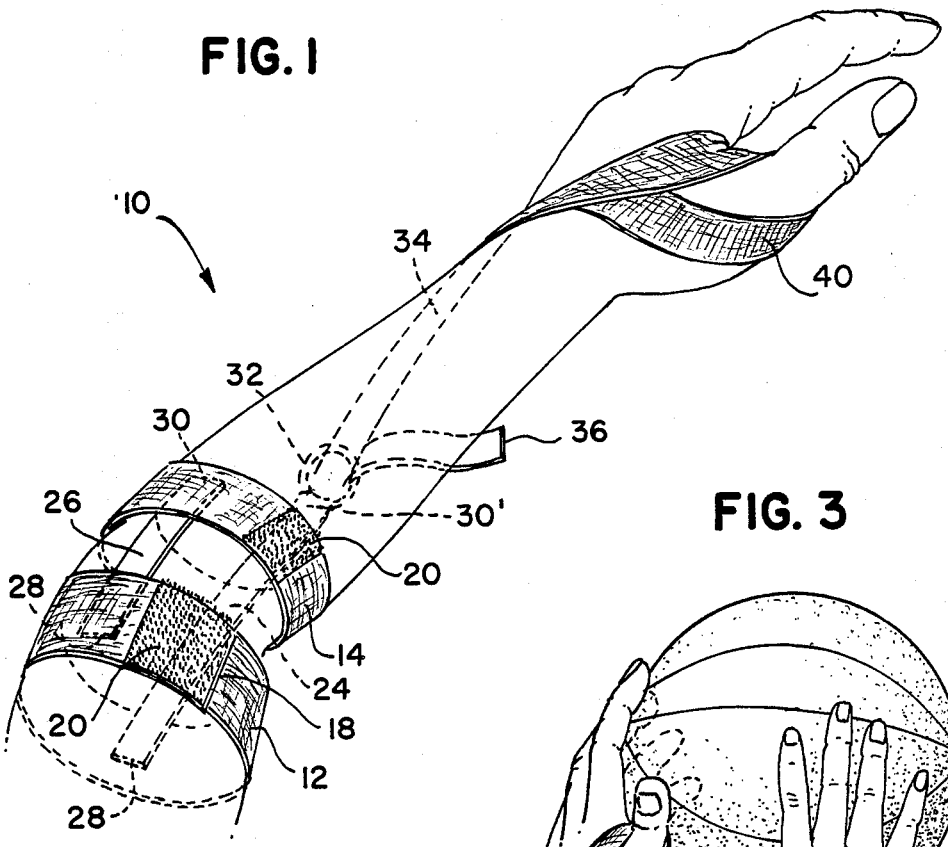
FIG. 1 shows a perspective view of the training and shooting aid as it appears when assembled upon the guide arm and hand of a basketball player.
Figure 3:
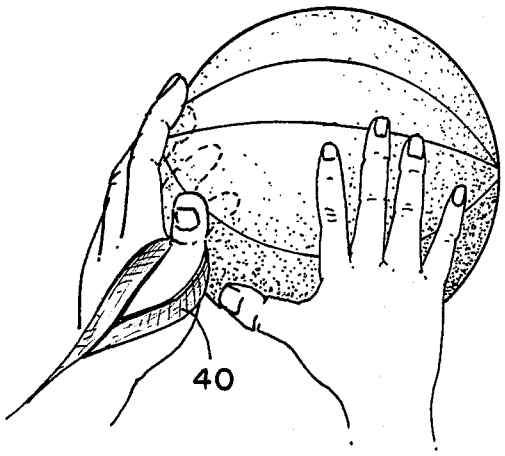
FIG. 3 is a fragmentary perspective view of the training and shooting aid as it appears when serving to pull the player's thumb upward, with the player's guide and shooting hands being shown holding a basketball.
Figure 2:
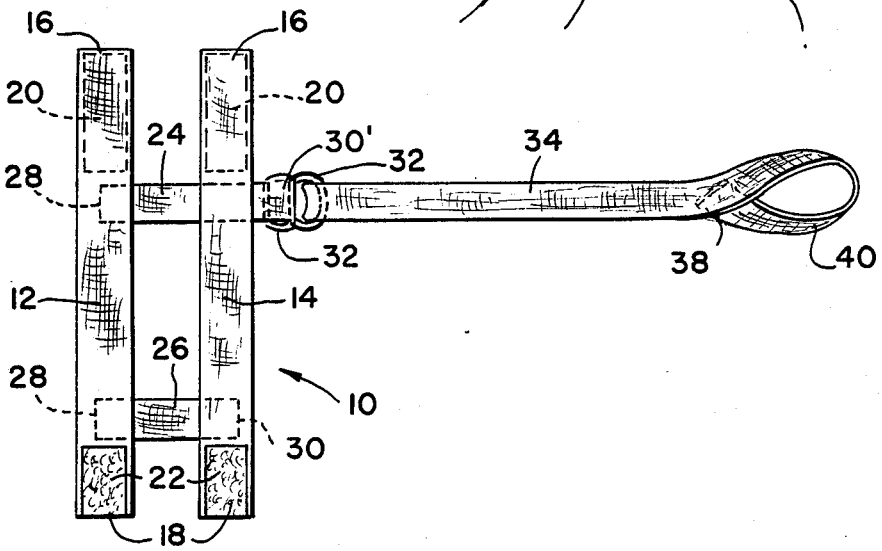
FIG. 2 is a plan view of the training and shooting aid.

With reference to the drawings and, in particular, with reference to FIGS. 1–3, the training and shooting aid of the present invention, as indicated generally at 10 in FIGS. 1 and 2, comprises a first band member 12 and a second band member 14. The first and second band members 12 and 14 are each fabricated of stretchable material, preferably 2 inch width elastic material, and have first free ends 16 and second free ends 18. The length of each of the band members, as measured from their first to their second ends, is sufficient to allow the band members to be snugly assembled around the arm of a basketball player, above and below the elbow, as depicted in FIG. 1.

The first and second band members are intended to be maintained in position around the wearer's arm by securing means provided on the free ends of the band members to secure the first end of each band member with respect to the respective second end of the band member. As illustrated in FIGS. 1 and 2, a preferred form for the securing means is a hook and loop type fastener of the Velcro® type wherein the appropriate Velcro® portions 20, 22 are provided on the first and second free ends of each of the band members. It is to be understood, of course, that other suitable securing means may be substituted for the Velcro® fastener illustrated herein for securing the first free end of each band member to the second free end of the band member around the arm of a player.

In order that the band members 12 and 14 may accommodate various arm sizes, the length of the band members and the securing means should be such as to allow the ends of the band members to be connected together at various points. The Velcro® fastener previously described readily performs the latter function merely by sizing one portion 22 of the fastener to be longer than the portion 20, which allows the portion 20 of the fastener to be secured to the portion 22 of the fastener at any desired point along its length as depicted in FIG. 1.

A pair of transverse strap members 24, 26 rigidly connect the first and second band members to each other at spaced locations along the length of the band members. In particular, as can be seen in FIG. 2, each of the strap members has a first end 28 secured by means of permanent stitching or the like to the first band member 12 and respective second ends 30, and 30' similarly secured to the second band member 14. As previously noted, the strap members 24 and 26 provide a relatively rigid interconnection between the band members and, as such, are fabricated from a non-stretchable material and, preferably, from a belt-like fabric. The length of the strap members 24, 26 is selected to be such as to allow band members 12 and 14 to be oriented above and below the elbow as previously described.

With reference to FIG. 2, it can be seen that the first strap member 24 is longer than the second strap member 26, having its end 30' extending beyond the second band member 14 to which it is secured. A pair of "D" rings 32 are secured to the first strap member 24 at its end 30'. The "D" rings, which are preferably formed from metal or a similar high-strength material, may be secured to the first strap member by any suitable conventional means, such as being retained in a loop formed on the end 30'.

The invention further comprises a third strap member 34 having a first free end 36, and a second free end 38 which is formed into a loop 40. The loop 40 is configured so as to allow it to be placed over the thumb of the player's hand. The free end 36 of the strap member 34 is intended to be threaded through the "D" rings 32 in such a manner whereby the length of the strap member 34, as measured from the loop 40 to the "D" rings may be adjusted by pulling the free end 36 which projects beyond the "D" rings. Additionally, it is intended that the "D" rings hold the strap member 34 in position at the desired length. The strap member 34, like strap members 24 and 26, is preferably fabricated of a non-stretchable material.

The training and shooting aid is intended to be utilized by a player manually placing the first and second band members around his guide arm. As is apparent in FIG. 1, the first band member 12 is intended to be located slightly above the player's elbow, while the second band member 14 is located slightly below the elbow. The band members are adapted to be snugly but comfortably secured around the player's arm by bringing the ends of the respective band members together, and securing the ends at the appropriate locations by means of the Velcro® fasteners or other securing means. The player then places the loop 40 of the third strap member 34 over the thumb of his guide hand and wraps the strap member diagonally across the front of the guide hand and forearm to the outer portion of the arm proximate the elbow whereupon the player threads the free end 36 of the strap member 34 through the "D" rings located slightly below the elbow. The free end 36 which projects from the "D" rings is then manually pulled upon by the player with his opposite hand so as to pull the thumb within the loop upward and outward towards the top of the arm and towards the elbow, as depicted in FIG. 3. With the third strap member so tightened, second band member 14 is prevented from sliding down the arm toward the hand by means of the first band member 12 above the elbow, in conjunction with the transverse strap members 24 and 26. It is apparent of course that the free end 36 may be threaded through the "D" rings prior to the device being applied to the player's arm.

The training and shooting aid of the present invention, when properly assembled upon the guide arm of a basketball player, does not allow the guide hand to rotate inwardly toward the basketball at the beginning of a shot. By inhibiting rotation of the guide hand toward the basketball, due to the hand being pulled back toward the elbow, the training and shooting aid prevents the guide hand from being relied upon to propel the ball. Additionally, the invention serves to effectively pull the thumb of the guide hand back toward the elbow, thereby eliminating the common tendency to utilize the thumb of the guide hand to propel the basketball. The subject invention thus insures that the shooting arm will be utilized by the player as the exclusive source of power for propelling the ball so as to obtain the desired intended trajectory without interfering forces from the guide arm and hand.

Although the invention has been illustrated and described in detail in connection with a preferred embodiment, it is to be understood that various modifications, additions, and changes may be made to the invention by one skilled in the art without departing from the spirit and scope of the invention as embodied in the appended claims.

What is claimed is:

1. A training and shooting aid for basketball players comprising at least a first band member and a second band member, said first and second band members having free ends, interconnection means for connecting said first band member to said second band member, said interconnection means being fabricated of a non-stretchable material, securing means associated with said band members whereby each of said band members may be adjustably secured around the guide arm of a basketball player, one of said band members being adapted to encircle said arm above the elbow, the other of said band members being adapted to encircle said arm below the elbow, a primary strap member fabricated from non-stretchable material and having a thumb-engaging member at its first end and having a second free end, receiving means associated with said second band member for receiving said second free end of said strap member, said thumb-engaging member being adapted to be secured upon the thumb of the guide hand of said player, said second free end of said strap member being adapted to be received by said receiving means whereby the length of said strap member with respect to said second band member may be adjusted so that said thumb is pulled upward toward said elbow and retained in said upward position.

2. The training and shooting aid recited in claim 1 wherein said band members are fabricated of a stretchable material.

3. The training and shooting aid recited in claim 1 wherein said interconnection means comprises at least a pair of secondary strap members, each of said secondary strap members having a first end secured to said first band member and a second end secured to said second band member.

4. The training and shooting aid recited in claim 3 wherein said secondary strap members are secured to said band members at spaced locations from each other.

5. The training and shooting aid recited in claim 1 wherein said securing means are Velcro® fasteners.

6. The training and shooting aid recited in claim 1 wherein said band members are adapted to be secured around arms of various sizes.

7. The training and shooting aid recited in claim 1 wherein said thumb-engaging portion is a loop member, said loop member being adapted to receive said thumb.

8. The training and shooting aid recited in claim 1 wherein said receiving means is a pair of rings, said second free end of said primary strap member being adapted to be threaded through said rings whereby said thumb is pulled upwardly by said player pulling upon said second free end.

9. A training and shooting aid for basketball players comprising a first stretchable band member and a second stretchable band member, said first and second band members having free ends, at least one non-stretchable transverse strap member interconnecting said first and second band members, securing means provided on said free ends of each of said band members whereby each of said band members may be adjustably secured around the guide arm of a basketball player, said first band member being adapted to snugly encircle said arm slightly above the elbow, said second band member being adapted to snugly encircle said arm slightly below the elbow, a separable primary non-stretchable strap member having a first end terminating in a loop and having a second free end, at least a pair of ring members provided on said transverse strap member for receiving said second free end of said primary strap member, said loop being adapted to be placed upon the thumb of the guide hand of the player, said second free end of said primary strap member being adapted to be threaded through said ring members whereby the length of said strap member with respect to said second band member may be adjusted so that said thumb is pulled upward toward said elbow and positively retained in said upward position.

10. The training and shooting aid recited in claim 9 further comprising a second non-stretchable transverse strap member interconnecting said first and second band members, said second transverse strap member being spaced from said first transverse strap member.

11. The training and shooting aid recited in claim 9 wherein said securing means are Velcro® fasteners.

12. The training and shooting aid recited in claim 9 wherein said ring members are metal "D" rings, said "D" rings being secured at an end of said strap member.

13. A method of using a training and shooting aid for basketball players characterized by first and second interconnected band members, each of said band members having first and second free ends, securing means associated with said free ends of each of said band members, a separable strap member having a loop at one end and a second free end, and a pair of ring members associated with said second band member, said method comprising the steps of:

(a) manually placing said first and second band members on the guide arm of a player;

(b) bringing said first and second ends of said first band member together around said arm so that said first band member snugly encircles said player's guide arm above the elbow;

(c) securing said first and second ends of said first band member together by means of said securing means;

(d) bringing said first and second ends of said second band member together around said arm so that said second band member snugly encircles said player's guide arm below the elbow;

(e) securing said first and second ends of said second band member together by means of said securing means;

(f) placing said loop of said separable strap member over the thumb of said player's guide hand;

(g) threading said second free end of said separable strap member through said ring members;

(h) manually pulling upon said second free end of said separable strap member which projects from said ring members in order to tighten said strap member, whereby said thumb is pulled upward toward said elbow.

* * * * *